United States Patent [19]

Stafford, III

[11] Patent Number: 5,024,381

[45] Date of Patent: Jun. 18, 1991

[54] ACTIVE RAILROAD SPIKE AND TIE PLATE INTERCONNECTION THEREFOR

[75] Inventor: Richard J. Stafford, III, Charlotte, N.C.

[73] Assignee: Stafford Rail Products, Inc., Lancaster, S.C.

[21] Appl. No.: 321,853

[22] Filed: Mar. 10, 1989

[51] Int. Cl.[5] ..... E01B 13/00

[52] U.S. Cl. ..... 238/367; 238/187; 238/295; 238/377

[58] Field of Search ..... 238/187, 295, 294, 298, 238/308, 309, 347, 366, 367, 368, 370, 371, 374, 375; 411/451, 487, 490, 922, 923

[56] References Cited

U.S. PATENT DOCUMENTS

| | | | |
|---|---|---|---|
| 161,975 | 4/1875 | Marshall | 411/487 |
| 1,387,689 | 8/1921 | Chicoine | 238/295 |
| 1,407,678 | 2/1922 | Roussel | 238/295 |
| 1,899,264 | 2/1933 | Faries | 411/923 |
| 2,650,032 | 8/1953 | Godfrey | 411/922 |
| 2,690,305 | 9/1954 | McComb | 238/366 |
| 2,777,642 | 1/1957 | Spencer | 238/375 |

FOREIGN PATENT DOCUMENTS

| | | | |
|---|---|---|---|
| 668332 | 11/1938 | Fed. Rep. of Germany | 238/367 |

*Primary Examiner*—Matthew C. Graham

*Attorney, Agent, or Firm*—Fitzpatrick, Cella, Harper & Scinto

[57] ABSTRACT

A rail spike for holding a tie plate on a tie, embodied in accordance with the invention so that tie cutting is prevented, spike removal for track maintenance is facilitated, and a free rail load wave is allowed. This preferably is attained by providing the spike with left and right side tapered shoulders and a tapered rear surface, such that a unique wedging and swaging action occurs in the tie plate hole during a final driving of the spike, limiting the depth of penetration of the spike into the tie and securely maintaining the gauge of the tie plate on the tie.

5 Claims, 5 Drawing Sheets

ACTIVE RAILROAD SPIKE AND TIE PLATE INTERCONNECTION THEREFOR

BACKGROUND OF THE INVENTION

1. Field of the Invention

This invention generally relates to railroad spikes, and more particularly to a novel and improved railroad spike which is actively interconnected with a tie plate hole by being swaged thereagainst, so as to both permit dynamic rail load wave, and minimize the problem of tie cutting while still facilitating spike removal for track maintenance.

2. Brief Description of the Prior Art

The shape of a railroad spike is generally defined by a set of standards, but a standard spike has a shank that is square and nominally 0.625 inches on each side. For example, rail is currently made to meet American Railway Engineering Association (AREA) specification 132 RE for the rail section (1962), and for such rail, Conrail has a standard track spike configuration, Conrail MW 181 (June 28, 1984), that requires conformance to the AREA specifications for Track Spikes, current issue. A railroad spike primarily holds rail gauge by securing a rail flange on top of a tie plate with the tie plate supported on a portion of a wooden tie upper surface. Conventional spike driving equipment almost invariably drives an AREA track spike all the way home, or into contact with the top of the rail flange. Hence, the rail, tie plate and spike become an assembly that initially is tightly fastened together, so that the rail cannot move with respect to either the spike, the tie plate or the tie.

This assembly invariably progressively loosens from dynamic rail load wave. Dynamic rail load wave is well known, and imparts a cyclical, vertical force that gradually pumps a spike out of the tie, causing the spike not only to lose its tie holding power, but also to invite decay in the tie hole. The contact between tie and tie plate also is loosened, and the tie plate than is free to move up down, and sideways (both laterally and longitudinally) thereby applying a pounding and cutting force onto the tie upper surface. The up and down motion occurs every time a train wheel passes over the assembly. While the free, or dynamic rail wave phenomenon is dependent upon the modulus of elasticity of the rail, and also the stability of the underlying rock bed, it has been found that for a 1.0 inch downward deformation of the rail (at mid span between two ties) that instantaneous deformation will cause an approximate 0.050 inch uplift, at the two adjacent tie plate regions. Hence, approximately 5 percent of a mid-span rail downward deflection is translated into an upward, or spike pumping force, that acts directly under the head of a spike that initially was driven into contact with the rail. Rail wave may be thought of as an "Irresistible force", since its magnitude far exceeds any inherent holding forces that can be generated between the shank of a spike and the wooden tie it was driven into.

While certain railroad manuals require a spike to be driven home, others recognize that a vertical spacing between the flange and the spike head of about 0.125 inch may be an optimum gap, so as to avoid the spike pumping phenomenon. However, tie cutting then is permitted to occur, due to horizontal as well as vertical movement of the tie plate, with respect tot he tie. Tie cutting represents a major cost component of railroad maintenance. Loosened spikes must be repeatedly redriven each time they are pumped out by the rail wave, and whole sections of track must be taken out of service when seriously cut ties have to be replaced.

One spike and plate design intended to minimize spike pulling effects of rail wave motion is disclosed in CHENEY (U.S. Pat. No. 1,604,806) wherein a spike shoulder or ear is defined to impart a vertical force on a tie plate, and limit the depth of penetration of the spike into the tie. Therefore, the rail is said to be free to move up and down in accordance with the rail wave. Hence, the special CHENEY tie plate also shows a non-tapered hole, while the holes in the plates used with the present invention typically taper inwardly about 0.10 inch; or from a top width of 0.850 inch to a bottom width of 0.750 inch. Further, CHENEY provides only a minimal point-to-point, shoulder contact with the tie plate, and no structure is available to resist movement of the tie plate forward, backward or sideways as a result of the horizontal forces of rail side loading. Further, it is most probable that an "initial settling" occurs under traffic due to contaminants such as grit or sand which have found their way between the tie plate and tie during installation. The tie plate will immediately disengage itself from the shoulder contact of the spike upon the slightest settling. Therefore, the most damaging, and critical, tie cutting problem is not at all addressed by CHENEY, CHENEY attempts to engage a tie plate upper surface, while the present invention primarily engages two or more surfaces defining the tie plate hole, by a novel swaging action imposed on the spike itself, to resist both lateral and vertical relative movement between tie and tie plate.

Another spike design is represented by WATERMAN (U.S. Pat. No. 791,521) wherein a tie plate hole is said to be made slightly smaller than the spike diameter, in order to prevent relative movement of the rail flange and spike. However, this configuration does not provide any relief to permit the necessary future act of spike pulling. Furthermore, and more damaging, upward and downward forces will now be transferred to both the spike throat and the tie plate, so a "pumping up" rail wave action would even more quickly destroy the holding power of the spike in the tie, while still further aggravating tie cutting.

A detachable spike shoulder used to limit the penetration depth of a conventional track spike into a tie is shown in AMES, U.S. Pat. No. 2,066,382. This detachable element provides only minimal surface contact with the tie plate, and would likely become separated from the spike head, under the forces of a rail wave.

CLARKSON (U.S. Pat. No. 2,271,912) demonstrates a divided shank rail fastener, wherein a rail leg formed at the rear base of the spike head, extending downward and away from the head, is used to limit the depth of penetration of the spike into a tie. Side to side movement of the tie plate will not be prevented by this assembly, since there is no provision for resisting horizontal forces that are incident to the rail load wave.

BOYCE (U.S. Pat. No. 1,837,183) illustrates a tie plate which limits the depth of penetration of a conventional track spike into an underlying tie by means of a shoulder formed in the tie plate. Since the spike used in this rail fastening assembly has a conventional straight shank, it will be eventually dislodged by the irresistible action of a rail wave.

OBJECT AND SUMMARY OF THE INVENTION

It is accordingly a principle object of this invention to provide a railroad spike that by design will actively engage both a tie plate and railroad tie with a geometry that prevents both elements from being lifted up or sideways, by the dynamic rail wave action of each wheel of passing trains.

Another object of this invention is to provide a railroad spike which will have a fixed height above the tie plate, due to an exponential driving force increase, but still have a relatively low release threshold, to facilitate spike removal from the tie plate and tie for track maintenance.

A third object of this invention is to provide a track spike which will resist ancillary gauge widening, while holding rail gauge primarily through a swaged contact between at least two sides of the spike and sides of a tapered hole in a tie fixing a tie plate. Because the tie plate thereby is firmly held against horizontal movement caused by rail side loading, tie plate cutting is also greatly reduced.

A fourth object of this invention is to provide a track spike which is readily forgeable on a production basis, and does not require either any special handling by a spike driver, or any special type of tie plate.

In order to attain these objects, a railroad spike of the general type discussed above is embodied in accordance with the invention such that it cannot be overdriven downward into contact with the upper surface of a fail flange. The spike is configured so that it is swaged when driven through a conventional tie plate hole that has a slight downward taper, and a minimum width dimension slightly smaller than the width of a first throat region of the spike. The depth of penetration of the spike into the tie thereby inherently is limited so that the head of the spike does not come into contact with the upper surface of a rail flange. Furthermore, the engagement of the spike with the tie plate hole causes a swaged engagement with the tie plate hole, that not only defines a vertical limit for the spike in its fully driven position, but also prevents any horizontal movement of the tie plate, with respect to either the spike or the tie.

These results are attained by departing from certain dimensions of a conventional AREA railroad spike specification through two tapered, planar or convex side shoulder surfaces, so that a wedging and swaging action of those surfaces occurs against at least two upper edges of a tie plate opening, during a final driving of the spike. The degree of wedging and swaging achieved is critically varied by the dimensions, shapes, and degree of taper of the spike side shoulders, up towards a reinforced region of the shank, proximate to the head member. In an alternate embodiment of the invention, the amount of swaging effect is a function of a wedging from left and right side shoulder surfaces, and wedging against a third ramp surface that extends outwardly from a rear shank surface of the spike. The reinforced region, above the pair of shoulders on the shank left and right sides further resists swaging. A spike produced in accordance with the present invention is readily adaptable to define different degrees of driving forces, without significantly increasing removal forces. The swaging effort thereby controls the vertical spacing of a spike head above a rail flange. The improved spike can be varied, for example, to define a holding configuration that is a function of the amount of traffic which regularly passes over a section of the railroad line.

The present invention essentially comprises left and right shoulders defining a wedge that extends outwardly from left and right side wall portions of the spike, to a region proximate and immediately below the head member of the railroad spike. Each wedge shoulder has a planar portion that insects a side wall of the shank of the spike, which typically is a square section with each side having a dimension of 0.625 inch. As noted hereinbefore, conventional tie plates have rail holes punched from the bottom, and have a lower dimension approximately 0.75 inch square, with the top of the tie plate being flared therefrom to define an upper dimension approximately 0.85 inch square. Since the nominal dimension of each side of a square spike is 0.625 inches, there will be a tolerance between such a spike and the bottom of the tie plate rail hole that is approximately 0.0625 inches (if the spike is centered within hole) and approximately 0.125 inches, if the spike is closely adjacent one side of the tie plate hole. Of course, at the upper surface of the tie plate rail hole there will be a further tolerance, of approximately 0.10 inches, due to the upwardly opening taper of a tie plate rail hole as it is manufactured.

To prove the essential function of the structure which will hereafter be more particularly described, long-term trials were made on a Union Pacific Rail line in Nebraska, in order to determine both the initial driving forces required to drive an active rail spike according to the invention into its desired position with respect to the tie plate on the rail, and also to determine, after time, whether the overall cooperation of structure defined herein will still permit removal of the active spike, without excessive removal forces. At a test site on a heavily used rail line outside of Lexington, Nebr., it first was determined that an initial point of engagement between the tapered sides of an active spike according to the first embodiment occurred upon exertion of a force in the vicinity of 8000 lbs. The initial point of engagement is defined as a contact between tapered shoulders on either side of the spike with an upper edge of the tie plate rail hole. For typical geometries, the initial point of contact occurs at approximately 6 inches above the chisel edge at the lower end of the spike, wherein the overall length of the spike is approximately 6.375 inches, as measured between the chisel point of the spike and the front lip underside of the head, that normally contacts the top of a rail flange. Hence, the swaging begins after approximately 6 inches of spike travel, and results in a wing or burr driven upwardly at the angle along each of the two left and right side wedge shoulders of the spike. The swaging area is angled due to the geometry of its contact with an angled dog on a tie plate, and at the end is approximately 0.5 inches in width, and approximately 0.375 inches in height. Beyond the initial point of engagement, it was found that a total driving force of approximately 30,000 lbs. was required in order to drive the spike an approximate additional 0.375 inches, so that the lip on the underside of the spike head is about 0.1875 to 0.250 inches above the upper surface of the rail flange. In order to further drive that spike another 0.125 inch, it was found that an average total force in the vicinity of 47,000 lbs. was required, and the spike still had not contacted the rail flange. On this point, it should be appreciated that conventional spike driving equipment, such as that made by Fairmount Manufacturing, is normally set at approximately 30,000 lbs. Hence, the swaging action of the present invention will result in a clearance of approximately 0.1875 to 0.250 inches between the lower surface of the spike head and the top surface of rail, without adjustment of the spike driving equipment, whatsoever. Furthermore, it should be appreciated that such driving equipment accurately applies forces when set at 30,000 lbs., or other normal settings, so that a 47,000 lb. force would be well outside any operating range variation. As noted hereinbefore, the initial point of contact, at 8000 lbs., represents the resistance of the spike against the tie. An approximate 0.375 inch further travel (a clearance space of approximately 0.25 inches) typically requires a total force of 30,000 lbs. To then drive another 0.125 inches, a total force of approximately 47,000 lbs., would be required. To overdrive the spike into a direct contact, or 0.125 inches of further travel, would require a total force significantly in excess of 50,000 lbs.

Therefore, the present invention has been found to define an approximate quarter inch clearance space with nominal spike driver settings of 30,000 lbs., and the total force required to decrease the clearance space from approximately 0.25 inches, down to 0, increases exponentially. Further, it should be apparent that if a free space between spike and rail is desired to be slightly less than 0.25 inches, and even as little as 0.125 inches, the spike driver can be set so as to cause the spike to be slightly further driven, without being overdriven into contact with the rail. It should also be noted that with respect to standard tie plates, of the 16 inch variety typically used by carriers such as Union Pacific, the tie plate not only has rail holes that are nominally 0.75 inches square, but also outward therefrom there are field holes, that nominally are also 0.75 inches square. The present invention as configured also will swage into an outboard or field hole, so as to contact the upper surface of the tie plate, in an area where no tie plate dog exists. In other words, the present invention not only is particularly useful for holding gauge within rail holes of a tie plate, but also will swage into field holes, and further assist in keeping a tie plate rigidly connected upon a supporting tie surface.

As used herein, the term "spike killing", refers to enlargement of the hole within the tie that is formed by driving of the spike. A "killed spike hole" is one that has become elongated due to lateral forces, and typically arises from breaking of the sheared edges of wood fibers, and then decay of the wood due to water entry. Spike killing is directly related to the pumping up action hereinbefore described, since a spike that is being pumped up due to the dynamic rail action will reorient the ends of the wood fibers (defining the surface of the tie hole) from down, to up. As a consequence, once the ends of the wood fibers are reoriented from down to up, it becomes much easier to further raise the spike with respect to the hole, since the fibers now are inclined in the direction of upward movement and the fibers no longer provide compression forces to resist upward motion. It is believed that upward motion of a spike greater than 0.125 inches will break off the exposed ends of the wood fibers, thereby hastening and aggravating the spike killing problem. Further, it is known from AREA studies that there is a fungus that lives on iron oxide. As spike killing occurs, the fungus, together with the moisture which then seeps in, aggravates rotting of the tie around the spike shank.

As previously discussed, the corollary to spike killing is tie plate cutting, since any contact between the spike shank and the tie plate hole is lost once the spike is pumped up, so that the tie plate freely responds to the dynamic rail wave action by cutting downward, into the upper surface of the tie. Prior art attempts to define contact among rail flange, spike shank and the tie plate served to aggravate the spike killing and tie cutting problems, instead of solving them. Since dynamic wave action is an irresistible force, if the rail, spike and tie plate are tightly connected, the rail not only lifts the spike (to initiate spike killing), but also cyclically lifts up, and pounds down, the attached tie plate; thereby aggravating the tie cutting problem. As a tie plate moves, sand and moisture enter under the tie plate, and the sand acts as an abrasive between the bottom of the tie plate and the upper surface of the tie.

Applicant further wishes to emphasize that simply leaving a clearance space between a conventional AREA spike and a rail, for example, will not result in the advantages achieved by the present invention. If a clearance is simply defined, you begin with a loose tie plate sitting on a tie, and tie cutting begins immediately. Hence, it has been considered conventional to drive a spike home, so that the tie plate will tend to be forced downward upon the tie, to delay the onset of tie cutting. Only the present invention both allows a space for rail uplift, while still fixing the tie plate both with respect to the shank of the spike and the supporting tie.

It also should be appreciated that if the force required to pull a spike out of a tie is approximately 7000 lbs., for example, and the dynamic wave action of the rail is less than 7000 lbs., the tendency is to raise up each tie, without affecting the bond between spike tie plate and tie. If the tie, tie plate, spike and rail move together, there will be a form of roller coaster effect, with the tie then being raised and dropped upon the gravel ballast, thereby chipping the ballast and making an abrasive sand.

It also is important to appreciate that due to the dog configuration of a tie plate, the contact between the tie plate and each side shoulder of a spike according to the invention is of an omni-directional nature. The tie plate then is prevented from twisting. Merely applying a vertical force between a spike shank and a tie plate would not resist the tendency of the spike and tie plate to be twisted in a horizontal plane, from the dynamic wave action of the rail. The invention not only prevents up and down motion between the spike and the tie plate, but also prevents the tie plate from moving sideways, because of a compound angle of swaged contact between a curved tie plate dog section and the planar or convex wedge shoulder on the spike.

A steel for spikes of the present invention may be equivalent to that used for conventional AREA spikes, such as 0.030 carbon content, which is in the category of high, but still relatively mild steel. Tie plate steel typically is of a higher carbon content, on the order of 0.50 carbon content. Hence, the relatively harder tie plate material cuts into the relatively softer spike material. As will be appreciated from the following description of preferred embodiments, the present invention accomplishes a swaging action entirely by a leading edge surface of a tie plate hole, and does not require any part of the spike to engage a top surface of the tie plate, in order to tightly hold the tie plate against the upper surface of a supporting tie.

Another very significant feature of the present invention is that the force required to remove a spike according to the present invention is not prohibitively high, as compared to the pull-out force required to remove a prior art AREA spike. Aging tests have shown that the average pull-out force required to remove an AREA spike is between 6150 and 7550 lbs. Both in the laboratory, and at the Union Pacific testing site, the first embodiment of the present invention has been shown to require a nominal 9000 lbs. pull out force, with the range being between 8600 and 10,800 lbs. This desirable result, even after heavy rail traffic appears to result from a tight bond between the side shoulders of the spike and the upper curved edge of the tie plate dog, since an angled swaging zone follows the curved surface of the tie plate dog.

The invention will now be described in more detail below, with reference to the drawing illustration of two exemplary embodiments.

DESCRIPTION OF THE PREFERRED EMBODIMENTS

Figure 1:
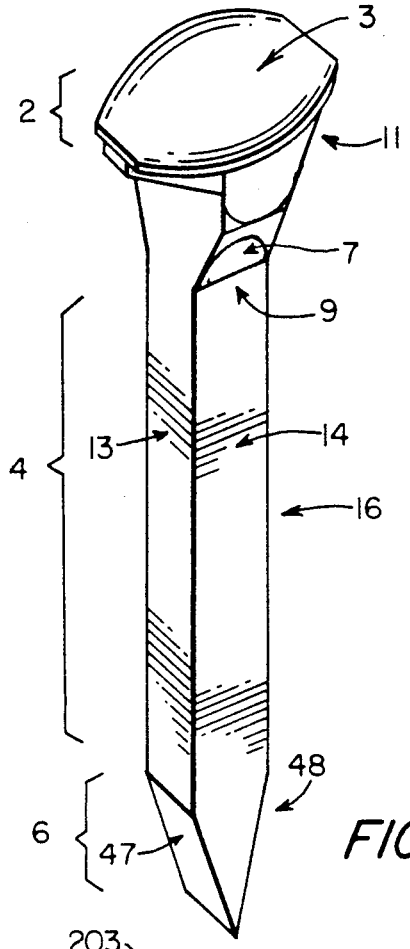
FIG. 1 is a perspective view of an active railroad spike in accordance with a first embodiment of the invention.
Figure 2:
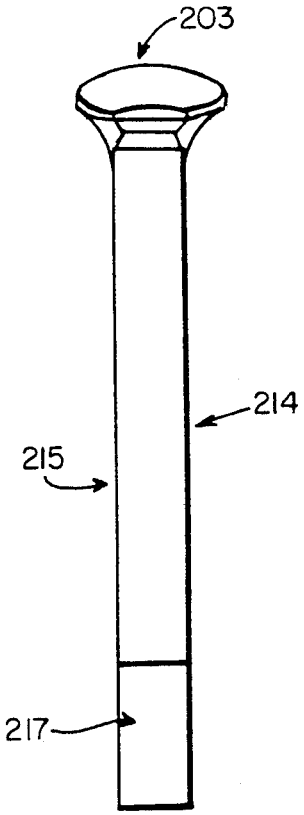
FIG. 2 PRIOR ART
FIGS. 2, 3, and 4 are respectively, front elevation, left side elevation and rear elevation views of a conventional prior art spike according to AREA specifications.
Figure 3:
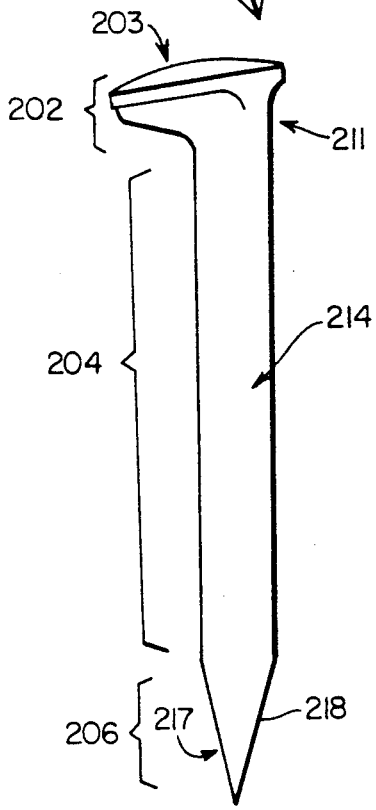
FIG. 3 PRIOR ART
Figure 4:
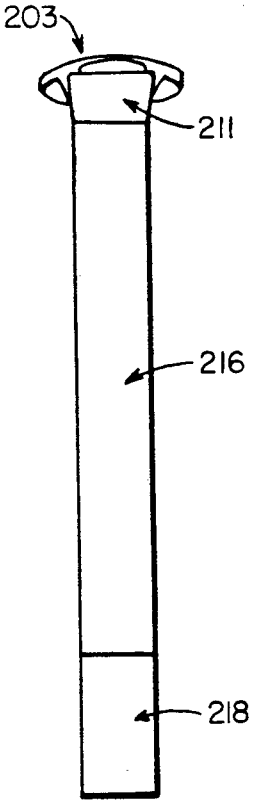
FIG. 4 PRIOR ART

The preferred embodiment of the invention is illustrated in the perspective view of FIG. 1, and also in FIGS. 5–8. For reference purposes, a conventional AREA railroad spike is illustrated and identified as prior art, within, FIGS. 2–4. With reference to FIG. 1, the active spike of the present invention comprises, a head region 2, a shank portion 4, and a bottom or penetrating end, 6. The shank further comprises four flat surfaces. A first or front wall, 13 is shown underneath an overhang, 5 of the head member, and a left wall, 14, a right wall, 15, and a rear wall, 16, also are identified. The penetrating end, 6, conventionally comprises a wedge front surface, 47 and a wedge rear surface, 48. With respect to those basic elements, the prior art AREA spike of FIGS. 2–4 has direct correspondence. The overall length of the spike of FIG. 1 and the prior art spike of FIGS. 2–4 are approximately the same, and the square shanks of each have equivalent dimensions, on the order of 0.625 inches. The prior art spike has a head member, 203, a shank portion 204, and a bottom or penetrating end, 206. Further, the conventional spike has a reinforcing section, 211, a left shank surface, 214, a right shank surface 215, and a rear shank surface 216. Accordingly, with respect to the head region, the shank region, and the penetrating end, the present spike has dimensions which are equivalent to that of a prior art spike, such as that shown in FIGS. 2–4. However, the present invention is not a passive spike, as is conventional in the prior art, but rather, is considered an active spike because of the improvements in a reinforced region that leis between the head member and the shank portion, as now will be more particularly described.

Figure 7:
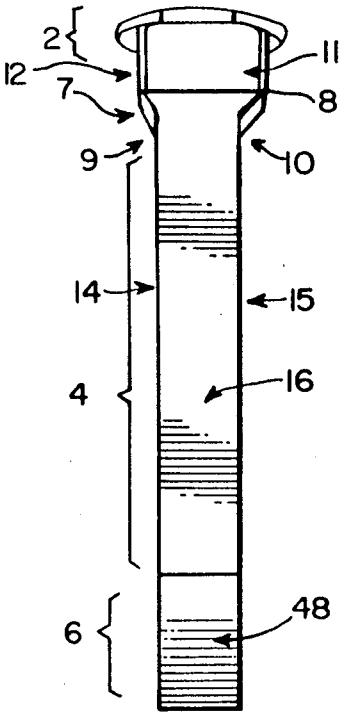
FIG. 7 is a rear elevation view of FIG. 1.
Figure 6:
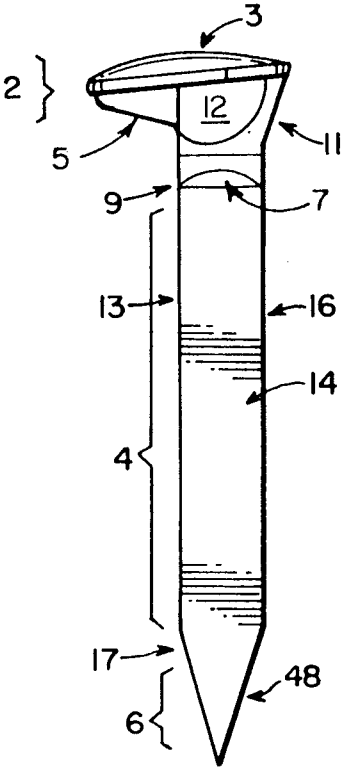
FIG. 6 is a left side elevation view of FIG. 1.
Figure 8:
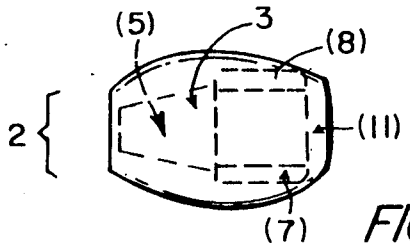
FIG. 8 is a top plan view of the spike head in accordance with the first embodiment of the invention; the dotted lines represent the underlying throat region and spike shoulders.
Figure 5:
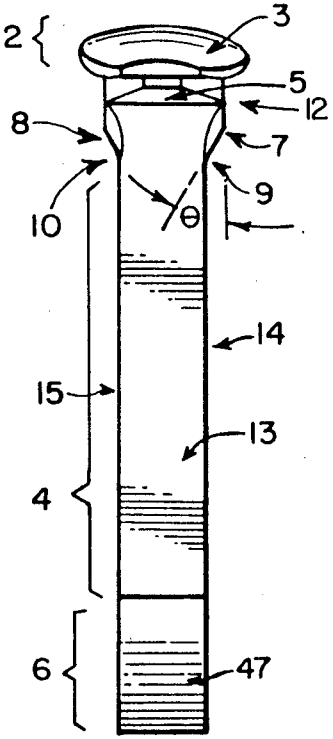
FIG. 5 is a front elevation view of the FIG. 4 spike, in accordance with the first embodiment of the invention.

With reference to FIG. 1 and FIGS. 5–8, it can be appreciated that the preferred embodiment comprises a shaped top surface, 3, which slopes downwardly towards the front of the spike to define a lip on its underside, 5. The front overhand extends transversely from the front wall, 13 of the spike in a tapered fashion, and beings at a point just above the top of a left shoulder wedge 7, and right shoulder wedge, 8. Each of the shoulders comprises a partial planar portion, 7, 8, surrounded by a rounded transistion to the reinforced portion of the shank, 11, 12. At the left underside of the head, there is a reinforced side surface, 12, as shown in FIG. 6. The right side has a mirror image of the left side surface, 12, and all further references will be with respect to the shank of the spike, for convenience. As shown in FIGS. 5 and 7, the left side reinforcement portion also comprises a rear inclined member, 11, which also tapers downwardly to a point of transition near the two left shoulders, 7, 8. The rear taper of the reinforcing section, 11, preferably approximately is 16 degrees with respect to the rear of the spike shank 4, and there is a transition to the rear shank surface, 16. This transition point is approximately 0.8125 inches below the top of the head member 2.

Each of the left and right side wedge shoulders (7,8) are located immediately below the reinforced shank region, and above the planar shank region, 4. The wedge shoulders taper inwardly to intersections, 9, 10 respectively, with the left and right side walls, 14, 15. The angle $\theta$ between the outermost edge of shoulder, 7, 8 and the shank, 4 is preferably 23 degrees plus or minus 3 degrees and this angle has been found significantly critical to produce an optimum degree of the swaging action within a tie plate hole, as discussed hereinbefore. As also noted hereinbefore, the material of this active spike is preferably 0.030 carbon steel, of the type conventionally used for prior art railroad spikes.

Figure 9:
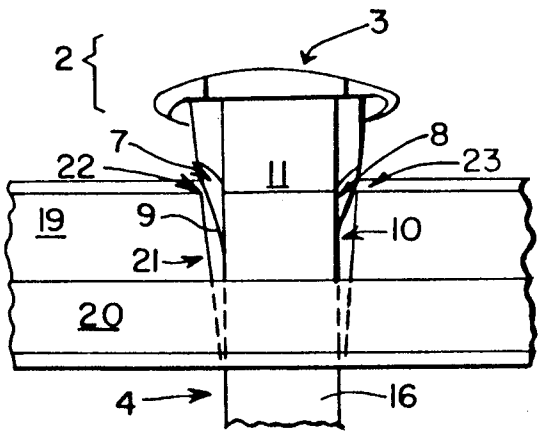
FIGS. 9 and 10 are rear elevation views of the spike head and upper shank regions in accordance with the first embodiment of the invention, respectively before and after a driving of the spike through a tie plate and into an underlying tie.
Figure 10:
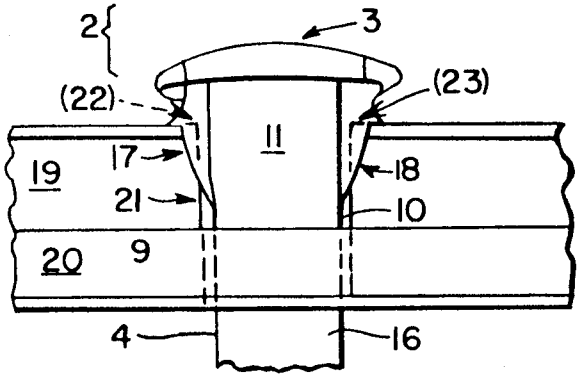
Figure 11:
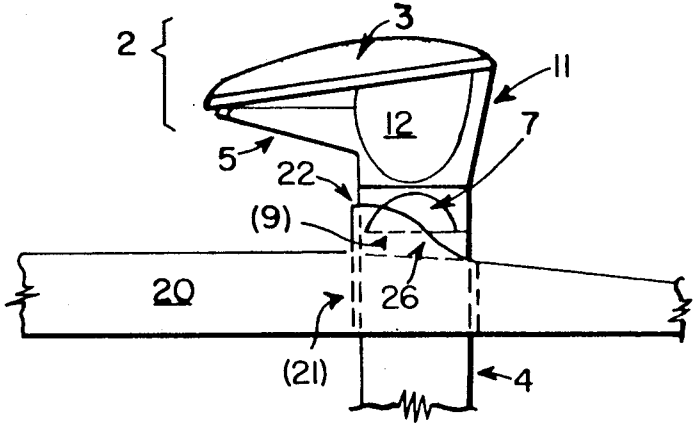
FIGS. 11 and 12 are left side elevation views in accordance with the first embodiment of the invention, that respectively correspond to the spike positions shown in FIGS. 9 and 10.
Figure 12:
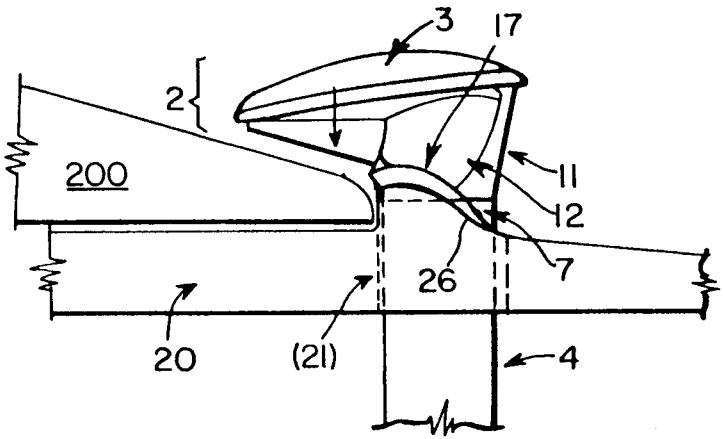

To illustrate how the preferred embodiment of FIG. 1, and FIGS. 5–8 cooperates with a tie plate in order to define the unexpected functions taught herein, reference may be had to FIGS. 9–12. FIGS. 9 and 10 are rear elevation views of the spike head and the upper shank regions, respectively before and after a driving of the spike into a tie plate and into an underlying tie. For clarity, a tie plate, 20, is shown, but its supporting is not illustrated. The tie plate, as is well known, is of slightly higher carbon steel content than the active spike, and comprises an essentially planar member, having a raised and curved dog, 26, which defines a laterally outward abutment to engage with the outer surface of a railroad flange, 200, as shown schematically in FIG. 12. Such tie plates are conventional, and further illustration is not required. Since the dog, 26 has an angularly curved surface, as shown in FIGS. 11–12, there is a compound curvature defined between that dog surface and a vertical rail hole, 21. The rail hole is punched upwardly from the bottom of the tie plate, 20, as hereinbefore discussed. The hole, 21, has a bottom square dimension of approximately 0.750 inches, and an upper square dimension,(in the vicinity of the top surface of the dog, 26) that is on the order of 0.85 inches. As shown in FIGS. 9 and 10, the tapered hole, 21 has an upper left edge surface, 22, and an upper right edge surface, 23. These edges are curved surfaces, and extend down the side of the dog 26, as a consequence of an intersection of the square hole, 21 that is punched through the dog of the tie plate. FIGS. 9 and 11 show a contact between an upper left surface of the tie plate hole, 22 and the inclined shoulder, 7 at a point of initial contact between the spike and the tie plate. In FIGS. 10 and 12, the spike is shown driven to its preferred final position, which does not allow a contact between the spike and an upper surface of the rail, 200. FIGS. 9 and 11 represent the spike geometry at a point of initial contact, which typically requires about 8000 lbs. of force for a typical oak tie, thereunder. The geometry of FIGS. 10 and 12, require approximately 47,000 lbs. of force from a spike driver, and the swaging action produces a configuration upon the left side of the spike, as shown in FIG. 12. Because of an inherent tendency of the spike shoulders to center the spike within a tie plate hole, the swaged wing of metal, 17, defined on the left side, is substantially a mirror image of the swaged wing of metal 18 formed on the right side shoulder, as shown in FIG. 10. As also shown in FIG. 10, the tie plate hole upper edges, 22, 23 are covered over by the respective swaged metal wings, 17, 18, and any further driving of the spike will require significant energy to be imparted for additional metal swaging. Each of the wings, 17, 18 shown are the result of metal swaged over a curved area of the respective spike shoulders that is approximately 0.5 inches wide, and approximately 0.375 inches in height. Due to the curved nature of the respective edges 22, 23 on the dog, 26 the forces generated between the spike and the tie plate actually are omni-directional, and tend to fix the spike with respect to the tie plate not only in the vertical direction, but also laterally or horizontally, with respect to the tie positioned thereunder.

As shown most clearly in FIG. 12, the rail flange 200 has a free space dimension between the lower surface 5 of the spike head and the upper surface of the rail flange that is preferably on the order of 0.125 to 0.250 inches, with a preferred clearance space being 0.1875 inches. This free space allows dynamic wave motion without contact between the rail and the head of the spike, while at the same time, the tie plate remains fixed both to the supporting tie and also to the railroad spike, itself. As discussed hereinbefore, this geometry prevents spike killing within the tie as a result of movement of the shank therein, and the tie plate, 20, also will not move upon the supporting tie upper surface. It also should be appreciated that in the final position of FIG. 12, grabbing of the spike head for purposes of removal is facilitated, since there is a clearance zone above both the rail flange and the tie plate upper surface. Still further, it should be appreciated that with respect to the geometry of FIG. 12, the swage wings 17, 18 will not resist upward pulling of the spike when it is time for replacement, and pulling forces on the order of 8000 lbs. have been found sufficient to dislodge the spike, even after a period of actual track line testing. Since that removal force is not significantly greater than the typical 7000 lb. force required to remove a well-seated prior art spike, there also is no need to further modify the spike pulling machinery, of a railroad maintenance machine.

Figure 13:
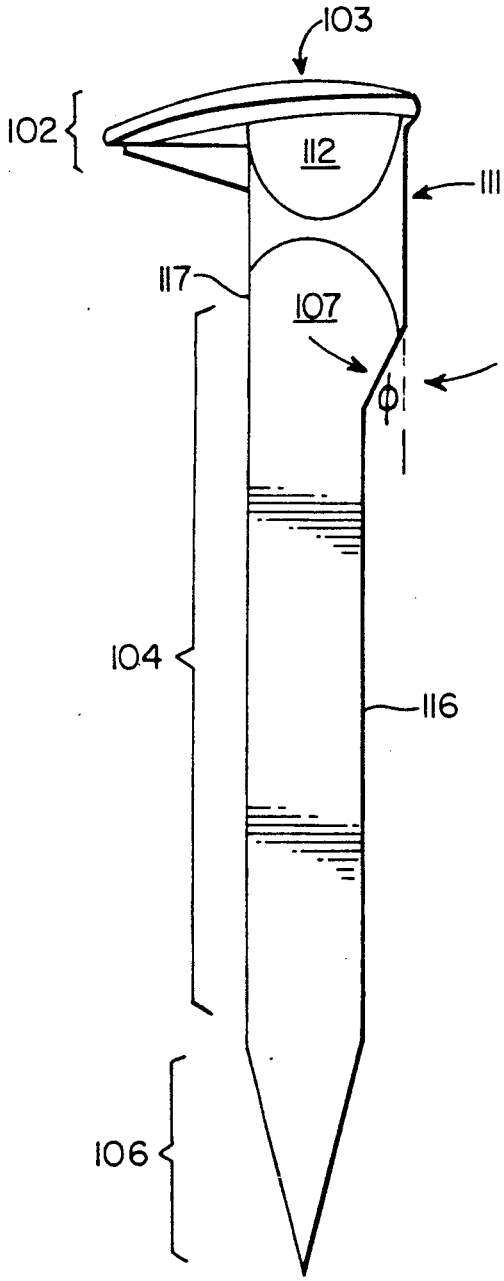
FIG. 13 is a left side elevation view of an active railroad in accordance with a second embodiment of the invention.
Figure 14:
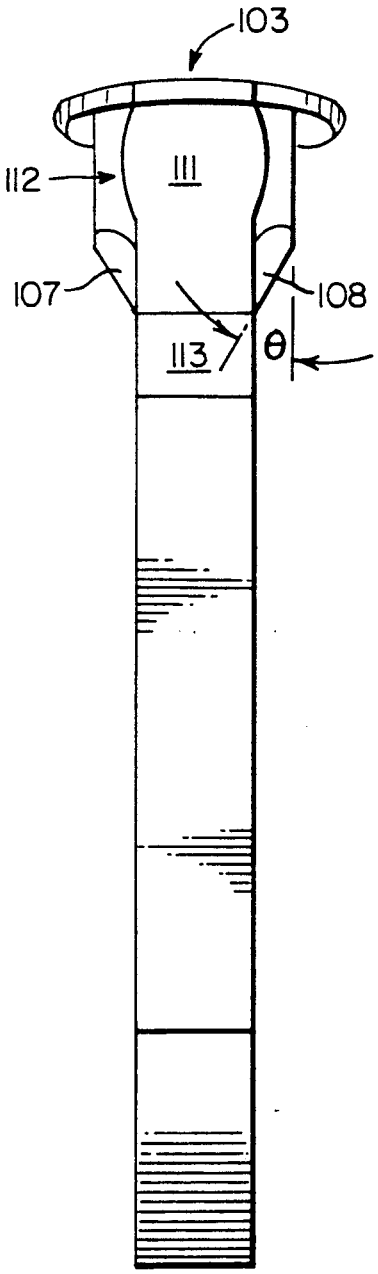
FIG. 14 is a rear elevation view of FIG. 13.

A second embodiment of the present invention is shown in FIGS. 13 and 14, wherein analogous parts are similarly numbered, with the addition of a factor of one hundred. The second embodiment has tapered side wedge shoulders 107, 108, for a swaging above the left and right side walls of the spike, and also a tapered rear shoulder, 113, which preferably has an included angle, $\phi$ of 23 degrees plus or minus 3 degrees. The intersection between the reinforcing section, 111 and the rear wedge shoulder, 113 is approximately 1.125 inches below the head, 103. As shown in FIGS. 13–14, the horizontal dimension between the rear shank reinforcing surface 111 and the front shank reinforcing surface, 117 preferably is between 0.875 inches and 1.006 inches. As in the first embodiment, the preferred dimension between the front shank surface, 117 and the rear shank surface, 116 is approximately 0.625 inches.

Figure 15:
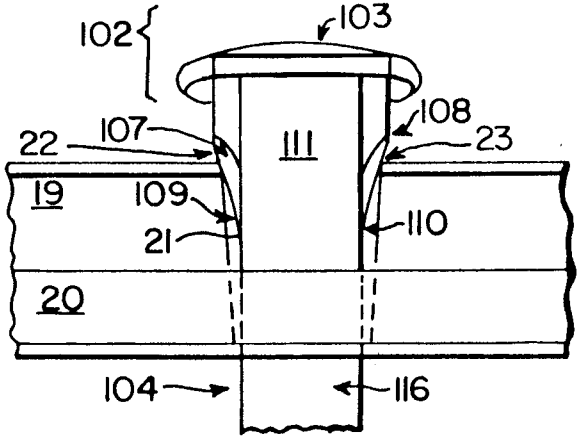
FIGS. 15 and 16 are rear elevation views in accordance with the second embodiment, respectively before and after a driving of the spike through a tie plate and into an underlying tie.
Figure 16:
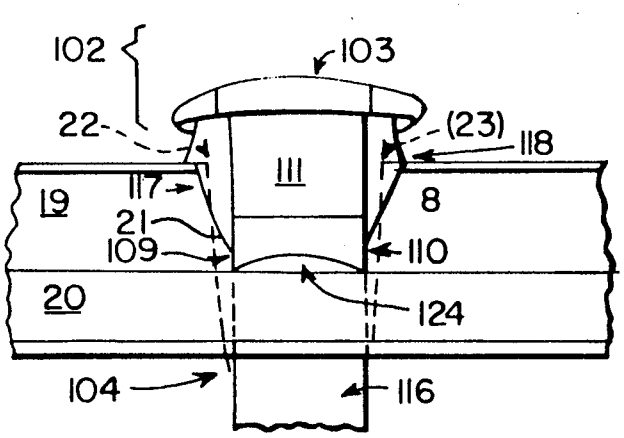
Figure 17:
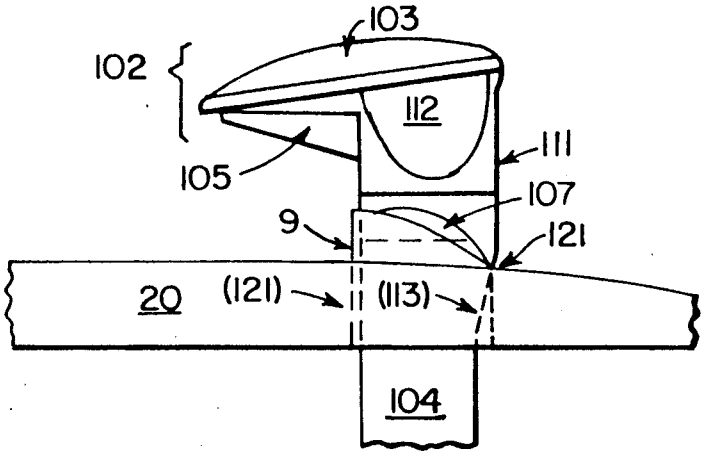
FIGS. 17 and 18 are left side elevation views in accordance with the second embodiment, that respectively correspond to the spike positions shown in FIGS. 15 and 16.
Figure 18:
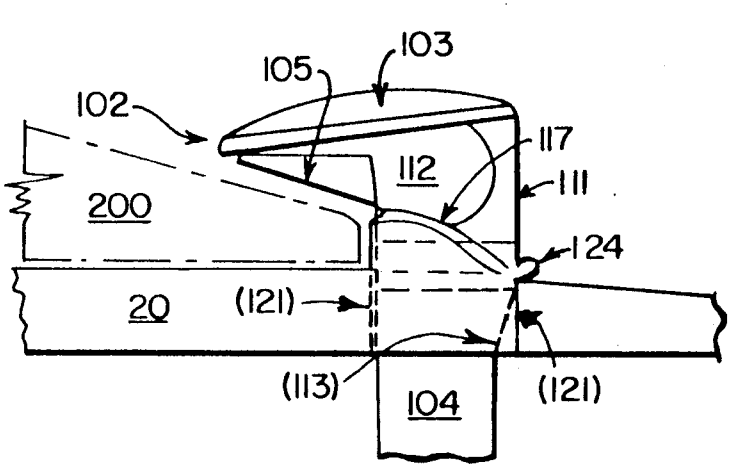

In order to illustrate use of a spike according to the second embodiment, FIGS. 15 and 16 are rear elevation views in accordance with the second embodiment, respectively before and after a driving of the spike through a tie plate and into an underlying tie (not shown). Likewise, FIGS. 17 and 18 are left side elevation views in accordance with the second embodiment, and correspond respectively to the spike positions shown in FIGS. 15 and 16. By comparing FIG. 18 and FIG. 12, it can be seen that a left side wing, 117 and a right wing, 118 are swaged upwardly, while a rear wing of swaged metal, 124 is defined above an upper rear edge, 121, of the tie plate. The second embodiment spike, 104 will tend to be tightly swaged in all directions with respect to the tie plate hole, 121, so that the undersurface of the spike head, 105 will be urged to the left, in FIG. 18, and towards the outer edge of the rail flange, 200. Consequently, in the second embodiment, there is essentially a four sided tightening of the spike with respect to a tie plate rail hole. Nonetheless, the rail flange, 200, still can move upward, in response to dynamic wave forces. The second embodiment is particularly useful for applications involving extremely heavy traffic, since any possibility of a twisting motion between the tie plate and the railroad tie is further resisted.

Having now described the preferred embodiment and an additional embodiment of my invention, it is to be understood that the invention is defined by the scope of the appended claims:

I claim:

1. In a railroad spike, intended for securing a tie plate to a tie, having a longitudinally elongated shank member with a top end, a bottom end, flat front, rear, left and right side walls, a head member proximate the top end of said shank member, a head member lower surface that extends transversely and overhangs said front wall, and a wedge-like bottom end with flat front and rear surfaces, the improvement which comprises a pair of wedge shoulders that extend upwardly and outwardly at an angle of approximately twenty-three degrees from the left and right side wall portions of the spike shank and connect with a reinforced portion of the spike that is below and proximate to the head member, the reinforced portion of said spike comprising a left and right side portion respectively extending substantially vertically above the left and right wedge shoulders, each wedge shoulder comprising substantially planar portions that define a wedge therebetween with at least one lateral dimension greater than an opening dimension between left and right sides of a tie plate rail hole, whereby upon driving of said spike into the tie plate rail hole, an inclined plane of contact is defined between said wedge shoulders and interior leading edge surfaces of the tie plate rail hole such that an increasing swaging action, occurring between said wedge shoulders and the edge surfaces of the tie plate rail hole, sufficient to prevent the head member lower surface from contacting, and the reinforced portion of the spike from contacting, an upper flange surface of the tie plate, is resisted by the left and right side portions of said reinforced portion of said spike.

2. In a railroad spike according to claim 1, wherein said reinforced shank portion further comprises a rear side portion that extends upwardly and outwardly from said shank rear surface, at an angle that is approximately 16° with respect to the rear surface of said shank member.

3. In a railroad spike according to claim 1, wherein said wedge shoulders connect with said reinforced shank portion at a point approximately 0.8125 inches below a top surface of said head member.

4. In a railroad spike according to claim 1, wherein the angle of inclination between a wedge shoulder and an adjacent shank surface is 23°, ±3°.

5. The combination of a rail, a railroad spike, a tie plate, and a tie supporting the rail and tie plate, wherein the spike comprises a longitudinally elongated shank member with a top end, a bottom end, flat front, rear, left and right side walls, a head member proximate the top end of said shank member, a head member lower surface that extends transversely and overhangs said front wall, and a wedge-like bottom end with flat front and rear surfaces, wherein the improvement comprises a pair of wedge shoulders on said spike that extend upwardly and outwardly from the left and right side wall portions of the spike shank and connect with a reinforced portion of the spike that is below and proximate to the head member, the reinforced portion of said spike comprising a left and right side portion respectively extending substantially vertically above the left and right wedge shoulders, each wedge shoulder comprising substantially planar portions that define a wedge therebetween, and being downwardly swaged into an opening dimension between left and right sides of a tie plate rail hole, such that an inclined plane of contact is defined between said wedge shoulders and interior leading edge surfaces of the tie plate rial hole whereby further driving of said spike into the tie plate is resisted by an increasing swaging action between said wedge shoulders and the edge surfaces of the tie plate rail hole sufficient to prevent the head member lower surface from contacting, and the reinforced portion of the spike from contacting, an upper flange surface of the tie plate at said rail and such that the swaging action is further resisted by the left and right side portions of said reinforced portion of said spike.

* * * * *